US005433267A

United States Patent [19]

Ammer et al.

[11] Patent Number: 5,433,267

[45] Date of Patent: Jul. 18, 1995

[54] FIRE TRUCK COOLING SYSTEM

[75] Inventors: John M. Ammer, New Haven; Patrick J. Murphy, Fort Wayne; Robert L. Dowler, New Haven, all of Ind.

[73] Assignee: Navistar International Transportation Corp., Chicago, Ill.

[21] Appl. No.: 128,417

[22] Filed: Sep. 28, 1993

[51] Int. Cl.[6] ..... F01P 7/10

[52] U.S. Cl. ..... 165/41; 123/41.08; 123/41.51

[58] Field of Search ..... 165/41; 123/41.08, 41.09, 123/41.18, 41.29, 41.43, 41.51; 122/418, 419; 237/12.2

[56] References Cited

U.S. PATENT DOCUMENTS

| | | | |
|---|---|---|---|
| 4,370,950 | 2/1983 | Furukubo | 123/41.08 |
| 4,628,872 | 12/1986 | Ogawa | 165/41 |
| 4,759,316 | 7/1988 | Itakura | 123/41.08 |
| 5,105,875 | 4/1992 | McArthur | 165/41 |
| 5,181,554 | 1/1993 | Mita | 165/41 |
| 5,201,285 | 4/1993 | McTaggart | 123/41.51 |
| 5,277,038 | 1/1994 | Carr | 165/41 |

*Primary Examiner*—Ira S. Lazarus
*Assistant Examiner*—Daniel J. O'Connor
*Attorney, Agent, or Firm*—Dennis K. Sullivan

[57] ABSTRACT

A fire truck cooling system allows for precooling of hot water from the vehicle engine prior to receipt of same by the vehicle radiator. The system includes a precooler which is provided with cooling water either from an onboard water tank when the vehicle is racing to a fire or from a fire hydrant when pumping water at the scene of the fire. A control system comprising pressure switches, a shuttle valve, and a directional control valve allows the precooler to operate on tank water and to automatically switch to hydrant water when such is made available by the main fire control water pump of the vehicle.

15 Claims, 1 Drawing Sheet

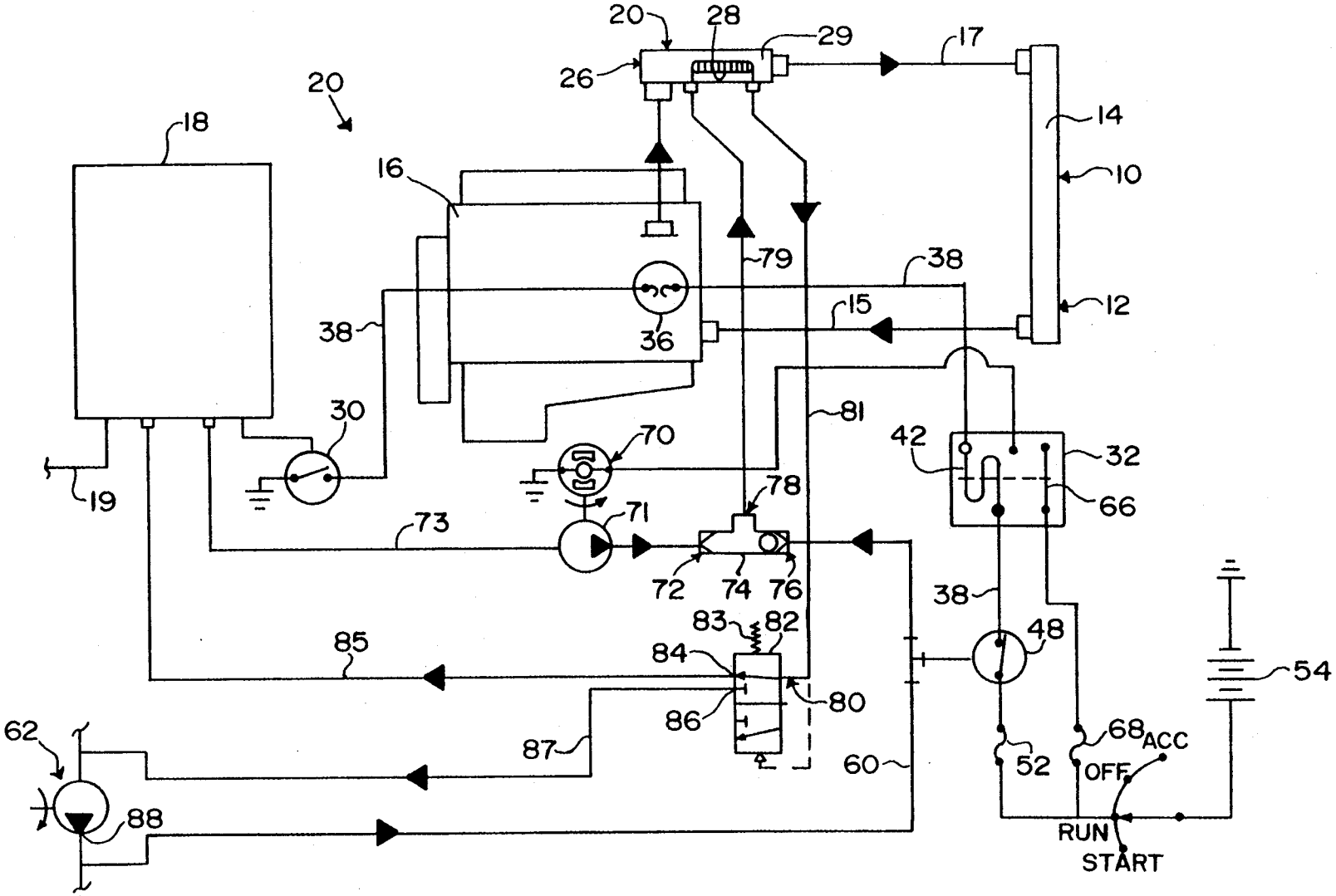
ACC
OFF
RUN
START

FIRE TRUCK COOLING SYSTEM

BACKGROUND OF THE INVENTION

The present invention relates to an auxiliary fire truck engine cooling system which increases engine cooling capacity by use of an auxiliary source of water and a precooler for hot water returning to the radiator from the engine. More specifically, in accordance with the present invention, water from an onboard water tank is used as needed for cooling en route to a fire location until water from a hydrant at the scene of a fire can be used to provide the additional cooling water.

THE PRIOR ART

As is well known, an internal combustion engine generates heat in proportion to the amount of work being done and this heat must be removed in order for the engine to function properly and efficiently. Larger engines, such as those used in fire trucks can generate great amounts of heat—especially when racing to a fire or when pumping water at a fire and, therefore, require a larger cooling system. Larger cooling means, however, can be costly and reduce engine efficiency by adding extra weight.

It is previously known to provide an auxiliary cooling system for fire trucks wherein an auxiliary precooler is installed on the hot water return line from the engine to the radiator. At the scene of a fire, water from the fire hydrant is supplied from the main pump of the fire truck to the auxiliary precooler to provide additional cooling during fire pumping operation. However, there remains the problem of overheating the oversized engine while the fire truck is traveling to the fire location, generally as fast as road conditions will permit.

To address this problem, the present invention proposes to use the existing—but heretofore unused—cooling water tank on board the fire truck and to switch to hydrant water at the scene of a fire.

SUMMARY OF THE INVENTION

Accordingly, it is a primary object of the fire truck cooling system of the present invention to provide additional engine cooling capacity for a fire truck which is effective when the truck is traveling.

It is a further object to provide a cooling system which utilizes available water in an onboard tank of the fire truck.

It is a yet further object to provide an auxiliary cooling system which will switch to water available from a hydrant at the scene of a fire without manual intervention if hydrant water is present.

These, as well as other objects which will hereinafter become apparent, are specifically met by the fire truck cooling system of the present invention of the type in which an auxiliary cooling unit works in unison with the main engine cooling system to provide hydrant water to precool hot coolant being returned to the radiator when the engine temperature exceeds a predefined upper limit. In the absence of hydrant water pressure, an on-board water tank of the type commonly provided on fire trucks is connected to an electrically powered auxiliary pump and then through a shuttle valve to the auxiliary precooler and is returned through a normally open differential pressure valve back to the tank, provided that there is sufficient water in the tank to actuate a tank pressure switch. When the main pump is connected to a hydrant, water is provided to the shuttle valve and to the differential pressure valve at higher pressures than that from the on-board tank. Thus, the auxiliary cooling circuit will automatically switch over to supply hydrant water while a normally closed main pump pressure switch opens to shut off electric power to the auxiliary pump.

BRIEF DESCRIPTION OF TEE DRAWING

Other objects and advantages of the invention will become more apparent upon perusal of the detailed description thereof and upon inspection of the drawing which is a schematic block diagram of the fire truck cooling system of the present invention.

DESCRIPTION OF THE PREFERRED EMBODIMENT

Referring now to the drawing in greater detail, there is illustrated therein a schematic block diagram of a fire truck cooling system made in accordance with the teaching of the present invention and generally identified by the reference numeral 10.

As shown, the system 10 accommodates provision of water from a source auxiliary to a main cooling system 12 of the fire truck (not shown) to precool hot water returning to a vehicle radiator 14 from an engine 16 thereof when excessive engine temperatures are sensed. Thus, the main cooling system 12 includes the radiator 14 which usually includes an input line 15 feeding into the water pump (not shown) of engine 16 and an outlet line 17 leading back to the radiator 14 from the engine 16, creating the closed loop primary engine cooling system 12, in known manner. The system 10 further includes an auxiliary water precooling system 20 which, for purposes of isolation of the engine water/antifreeze coolant to avoid cross contamination thereof, includes an auxiliary precooler 26 provided in the outlet line 17 from the engine 16 to the radiator 14. Water circulates through an auxiliary water side 28 of the precooler 26 drawing heat from the hot coolant flowing therearound through a casing 29 of the precooler 26, returning precooled coolant at a lowered temperature to the radiator 14, increasing cooling efficiency thereof.

A fire truck typically has mounted thereon an onboard water tank 18 from which fire control water can be supplied as through line 19 for use on small fires or if no fire hydrants are available near a fire. This tank 18 is usually full of water which is not used when the truck is en route to a fire. Thus, it can nicely serve as an auxiliary source of cooling water for the engine 16 while the vehicle is racing to a fire and provide additional cooling capacity without increasing vehicle weight by the addition of further water storage thereto.

In order to provide for automatic access to this auxiliary source of water, on an as-needed basis, and only when sufficient water is available within the tank 18, the auxiliary cooling system 20 is provided with electric controls. In order to ensure that a sufficient amount of water is available in the tank 18, a normally closed pressure switch 30 is operatively engaged to the water tank 18 and is disposed in an electrical circuit 38 leading from ground to the coil 42 of a normally open relay switch 32, the contacts of pressure switch 30 being maintained closed when sufficient water pressure is sensed by switch 30 in the tank 18.

Further disposed in series in the electrical circuit 38 between the pressure switch 30 and the relay coil 42 is a normally open temperature switch 36. If engine temperature becomes sufficiently elevated, as occurs when the engine 16 is working hard, temperature switch 36 will close at a predefined temperature.

The circuit 38 for relay coil 42 further includes a normally-closed pressure switch 48 disposed to sense water pressure in a water line 60. To complete the circuit 38, the switch 48 is connected, through a fuse 52, to the positive side of a vehicle battery 54 through vehicle ignition switch 56. The negative side of the battery 54 is grounded.

On the way to a fire, if there is sufficient water sensed in the tank 18 to maintain pressure switch 30 closed, and, if the engine temperature sensed by temperature switch 36 is sufficiently high to cause switch 36 to close, and, if no water pressure exists in line 60, pressure switch 48 is maintained closed, completing the circuit 38 from the battery 54 through ignition switch 56, fuse 52, switch 48, energizing coil 42 of relay switch 32, temperature switch 36, pressure switch 30, to ground. This completed circuit causes energization of relay switch 32, closing the switch contacts 66 thereof to complete electrical circuit 40 between the positive terminal of the battery 54 through ignition switch 56 and fuse 68 to one terminal of a motor 70 of an auxiliary pump 71, the other terminal of motor 70 being grounded.

Thus, upon closure of relay switch contacts 66, auxiliary pump 71 is energized and begins pumping water from the onboard tank 18 through line 73 to an input port 72 of a shuttle valve 74. Inasmuch as no water pressure is present in line 60 from pumping of a main water pump 62 of the vehicle while the vehicle is travelling, no pressure is present at an opposite input port 76 which is connected to the outlet of main pump 62. Thus water will flow through the input port 72 from the tank 18 to an output port 78 of the valve 74 which is connected by line 79 to the auxiliary water side 28 of the precooler 26. The tank water is returned from the precooler 26 through line 81 to an input port 80 of a two-position, pilot-operated (or solenoid operated) directional control valve 82 of sufficient size for the relatively large cooling flow required which is biassed by spring 83 to normally connect input port 80 to output port 84 which is connected by line 85 to the tank 18.

Thus, precooling of hot coolant headed to the radiator 14 from the engine 16 is accomplished using an exiting source of water without adding further weight to the vehicle. Once on site at a fire, if water is being pumped for fire control from the on-board tank, the auxiliary cooling will continue, albeit with decreasing effectiveness at low tank water levels as the water temperature increases, until the on-board tank is sufficiently exhausted to allow pressure switch 30 to open. However, if the water being pumped for fire control is drawn from a hydrant by main pump 62, a second source of water becomes available for use in the precooling of the coolant. Two conditions must be met for use of this source of water.

First, sufficient pressure must exist at an output 88 of the pump 62 to pressurize line 60 and open normally closed pressure switch 48, preventing relay switch 32 from energizing auxiliary pump 71. Secondly, sufficient pressure must exist at port 80 to overcome the biassing spring 83 and operate directional control valve 82 to connect port 80 to port 86 of control valve 82 and thus establish a return path for the hydrant water through line 87°

When the main pump 62 is activated, a portion of the water from the output of main pump 62 will flow into and through line 60 and at a pressure much higher than that from auxiliary pump 71. That pressure will open pressure switch 48 and cut off the power supply to the motor 70 of auxiliary pump 71. The pressure in line 60 causes a greater pressure to be applied to input 76 of shuttle valve 74, rather than to input 72 thereof, allowing water from the line 60 to exit outlet 78 from the shuttle valve 74 and to flow through line 79 into the precooler 26 and return through line 81 to the input 80 of the directional control valve 82. The main pump pressure is sufficient to overcome spring 83 and change the position of directional control valve 82 so that water flowing into input 80 of valve 82 will be directed to port 86 and through line 87 to the input of the main pump 62.

As described above, the fire truck cooling system of the present invention provides a number of advantages, some of which have been described above and others of which are inherent in the invention. Also, modifications may be proposed without departing from the invention herein. Accordingly, the scope of the invention is only to be limited as necessitated by the accompanying claims.

What is claimed is:

1. In a fire truck engine cooling system including a main cooling system incorporating a radiator and coolant passing to and from the radiator to an engine of the vehicle and a precooler system engaged within a line bringing hot water from the engine to the radiator, the precooler being supplied with water from an auxiliary preexisting source thereof outside the main cooling system, the improvement wherein said auxiliary preexisting source is an on-board tank carried by the fire truck, said tank having means associated therewith for removing fire control water therefrom.

2. The system of claim 1 wherein fire hydrant water from a main fire pump of said fire truck, when available, is an additional auxiliary source of water, each source being selectively engageable to a feed line to the precooler through a shuttle valve.

3. The system of claim 2 further including control means disposed to automatically select hydrant water upon both hydrant water and tank water being available.

4. The system of claim 2 wherein water from the onboard tank is supplied to the precooler by activation of an auxiliary pump functionally engaged in a water line leading from the tank to one input of the shuttle valve.

5. The system of Claim 4 further including an electric control circuit for controlling the operation of said auxiliary pump including a relay switch having contacts connected respectively between the auxiliary pump and a power supply and a coil circuit connected to a power supply including in series with the coil one or more of a tank pressure switch, a coolant temperature switch, and a hydrant water pressure switch.

6. The system of claim 5 wherein said tank pressure switch is closed when water is in said tank.

7. The system of claim 5 wherein said coolant temperature switch is normally open and is closed when engine temperature exceeds a predefined level.

8. The system of claim 5 wherein said hydrant water pressure switch is normally closed and upon being exposed to hydrant water pressure, opens to break the circuit to said relay coil.

9. The system of claim 2 wherein hydrant water is supplied to a second input of the shuttle valve by an auxiliary water line feeding off an outlet from a main hydrant water pump.

10. The system of claim 2 wherein a directional control valve is disposed in a return line from said precooler and selectively operable to connect the return line to the tank or the hydrant water supply.

11. The system of claim 10 and said control valve being normally disposed in a position connecting said return line to said tank and being operable by return line pressure to connect said return line to said hydrant water supply.

12. In combination with a fire truck having an onboard water tank, a fire water pump adaptable to pump water from a hydrant water supply, an engine, and a closed circuit engine cooling system, an auxiliary engine cooling system comprising:

a water-to-coolant heat exchanger having a coolant side operatively disposed in said engine cooling system;

a water supply circuit connected to a water side of said water-to-coolant heat exchanger including a first supply line, including an auxiliary pump, connected between said tank and a first input port of a differential pressure operated shuttle valve, and a second supply line connected between said fire water pump and a second input port of said shuttle valve, said shuttle valve having an output line to said heat exchanger;

a water return circuit connected to the water side of said heat exchanger including a return line and a directional control valve operatively disposed to selectively direct water either to said tank or to said fire water pump supply; and an electric control circuit means disposed to actuate said auxiliary pump only in the absence of pressure in said second supply line.

13. The system of claim 12 wherein a tank pressure switch is disposed in series in said control circuit means, said tank pressure switch being closed only when water is in said tank.

14. The system of claim 12 wherein a coolant temperature switch is disposed in series in said control circuit means, said coolant temperature switch being closed only when engine temperature exceeds a predefined level.

15. The system of claim 12 wherein a hydrant water pressure switch is disposed in series in said control circuit means, said hydrant water pressure switch, upon being exposed to hydrant water pressure in said second supply line, opening to break the said control circuit means, thereby interrupting the operation of said auxiliary pump.

* * * * *